US005960665A

United States Patent [19]

Schoellhammer

[11] Patent Number: 5,960,665

[45] Date of Patent: Oct. 5, 1999

[54] DRAWING DEVICE FOR DRAWING PRESSES

[75] Inventor: Dietmar Schoellhammer, Goeppingen, Germany

[73] Assignee: Schuler Pressen GmbH & Co., Germany

[21] Appl. No.: 09/045,692

[22] Filed: Mar. 23, 1998

[30] Foreign Application Priority Data

Mar. 21, 1997 [DE] Germany ..... 197 11 780

[51] Int. Cl.[6] ..... B21D 24/08

[52] U.S. Cl. ..... 72/351; 72/453.13

[58] Field of Search ..... 72/350, 351, 453.13

[56] References Cited

U.S. PATENT DOCUMENTS

| | | | |
|---|---|---|---|
| 1,638,881 | 8/1927 | Rode | 72/351 |
| 1,962,281 | 6/1934 | Myhrum | 72/351 |
| 1,970,134 | 3/1934 | Ferris | 72/358 |
| 4,635,466 | 1/1987 | Seki et al. | 72/351 |
| 5,255,552 | 10/1993 | Bielfeldt | 72/351 |
| 5,687,598 | 11/1997 | Kirii et al. | 72/351 |

FOREIGN PATENT DOCUMENTS

| | | |
|---|---|---|
| 0 401 534 A1 | 12/1990 | European Pat. Off. . |
| 0 740 968 A1 | 11/1996 | European Pat. Off. . |
| 385414 | 11/1923 | Germany . |
| 40 16 838 A1 | 11/1991 | Germany . |

*Primary Examiner*—Lowell A. Larson
*Attorney, Agent, or Firm*—Evenson, McKeown, Edwards & Lenahan, P.L.L.C.

[57] ABSTRACT

A drawing device for drawing presses has a sheet holding ring which travels along the entire drawing path during the drawing operation. For admitting a corresponding sheet holding force to the sheet holding ring, a pneumatic force generating device is provided whose pressure cylinders generating the force are permanently or statically acted upon by compressed air with a defined pressure volume. For adjusting the sheet holding force, the corresponding pistons of the force generating device can be acted upon on their opposite side with counterpressure of a defined pressure level. Thus, the course of the sheet holding force can be adjusted by way of the drawing depth. For local adjustment of the distribution of the sheet holding force along the sheet holding ring, hydraulic cylinders are arranged between the sheet holding ring and the pressure box, and are combined into groups. Communicating by way of switch-over valves 46, these hydraulic cylinders can be switched to a first reservoir and, communicating alternatively, can be switched to a second reservoir. In conjunction with the pneumatic force generating device, the hydraulic cylinders supply a certain buffer or damping effect which becomes effective when the pressure surface is placed on the sheet bar situated on the sheet holding ring.

14 Claims, 4 Drawing Sheets

DRAWING DEVICE FOR DRAWING PRESSES

This application claims the priority of German application 197 11 780.5, filed Mar. 21, 1997, the disclosure of which is expressly incorporated by reference herein.

BACKGROUND AND SUMMARY OF THE INVENTION

The present invention relates to a drawing device, and more particularly, to a deep drawing press, having a pressure box which is used as an abutment for generating a clamping force for holding a sheet edge and which is disposed to be movable in the drawing direction by a defined drawing depth, having a force generating device which, on one end, is connected with the pressure box and which, on the other end, is supported on a stationary bearing, for acting upon the pressure box by means of a force parallel to the drawing direction, having force transmitting elements for transmitting the clamping force to a sheet holding device.

As a rule, drawing tools have a sheet holding ring which is assigned to the bottom tool and presses the edge of the metal sheet to be drawn before the start of the actual drawing operation against a corresponding abutment of the top tool fastened to the lowering slide. Thereby, the metal sheet ring is held fast. In this arrangement, the sheet holding ring must be pressed in a defined manner against the abutment on the top tool, while the slide continues to be lowered. Optionally, the adjustment of different clamping forces may be desired at different points of the sheet holding ring in order to, for example, influence the flow of material. In addition to the local change of the flow of force, a time variation of the flow of force is frequently also required, for example, a decreasing sheet holding force may be required with an increasing drawing depth.

DE 40 16 838 A1 describes a drawing device which has a hydraulically vertically adjustable pressure box. For the height adjustment, four servohydraulically controlled pressure cylinders are used which are each arranged on the corners of the pressure box which is rectangular in view. The pressure cylinders have a working stroke which essentially corresponds to the required drawing depth. Studs are provided for transmitting the contact pressure force from the pressure box to the blank holding ring. These studs extend through openings of a stationarily disposed table plate which is arranged between the sheet holding ring and the pressure box. Hydraulic short-stroke cylinders are arranged on the pressure box in which one piston respectively is disposed in a vertically displaceable manner. A stud or a stud position is assigned to each piston. The short-stroke cylinders are combined by groups and connected with a control device which permits the servohydraulic control of fast movements. In addition, the hydraulic short-stroke pistons permit an automatic length compensation of possible length differences of the studs.

For hydraulic lowering and lifting of the pressure box in the timing of the press, however, a relatively efficient source is required for filling the corresponding hydraulic cylinders. Control of the total applied holding force as a rule takes place by throttling devices and is therefore a function of the speed. The slide speed changes during the drawing operation so that a constant readjustment is required. In addition, the stiffness of the hydraulic drive requires a permanent and fast control.

DE 40 16 838 A1 describes a drawing apparatus in which the pressure box is not force-controlled but path-controlled. For this purpose, a vertically displaceable pressure box called a pressure cheek is acted upon by a pressure rod with a vertically upwardly directed force. Distance bolts are provided on both sides of the pressure cheek and are aligned with distance bolts provided on the slide. When the slide moves downward, its associated distance bolts are placed on the distance bolts of the pressure cheek and press the latter downward against the force of the pressure cheeks which is not additionally controlled or directed. Thus, a fixed distance is adjusted between the slide and the pressure cheek. The pressure cheek carries a group of hydraulic cylinders which act upon the sheet holding ring by way of pressure slides. The hydraulic cylinders are connected to pressure control devices to make adjustment of the force transmitted by way of the respectively actuated stud to the sheet holding ring possible. As a rule, hydraulic proportional valves are used for this purpose. Because of the occurring shock-related stress, however, the arrangement of the hydraulic proportional valves on the pressure cheek is critical.

It is an object of the present invention to provide a robust drawing device which permits at least the control of the sheet holding force as a function of the time or as a function of the drawing path.

This object is achieved by a drawing device according to the present invention providing a force generating device with a controllable pneumatic driving device.

More specifically, the drawing device according to the invention has a pressure box which is supported on a pneumatic driving device. This driving device can be controlled with respect to the development of its force so that the sheet holding force can be adjusted as a function of the drawing depth. Apart from acceleration (inertia) forces, the sheet holding force therefore depends solely on the pressures acting on the pneumatic driving device. When, for example, different pressure levels are to be adjusted, it is sufficient to connect the pneumatic driving device with pressure reservoirs which have a correspondingly different pressure. The buffer effect or spring effect inherent to the pneumatic driving device prevents a short-time excessive rise of force. In contrast to hydraulic drives, a corresponding control device for controlling the force generated by the force generating device (driving device) is subjected to much lower demands.

Whereas, in hydraulic systems, during the drawing stroke, the sheet holding force is applied by the controlled throttled discharges of hydraulic fluid from corresponding hydraulic cylinders and, during the return stroke of the slide, the pressure box must be moved upwards again hydraulically, for which relatively high-capacity pumps are required, the pneumatic driving device permits this operation to take place by utilizing correspondingly large buffer volumes.

In a particularly advantageous embodiment of the present invention, the pneumatic driving device is constructed as a differential pressure arrangement. The device has two mutually oppositely operating working spaces and is free of forces when both spaces are acted upon by pressure. As a result, the sheet holding force can be reduced by the targeted admission of pressure to one working space and can be increased when this pressure space is relieved from pressure. By the targeted admission of pressure to the working space, which generates a force directed in the moving direction of the pressure box, measures can be taken against the rise of the sheet holding force by way of the drawing course. Thereby, the sheet holding force can be reduced toward the end of the drawing stroke, as is frequently required. Furthermore, during the return stroke of the slide, the drawing device can be blocked or braked. In addition, a damping is possible when the pressure box moves up.

When the pressure box moves up, the working space, which is reduced in this embodiment, can be utilized as a buffer volume if a corresponding control device is configured correspondingly. Toward the end of the return stroke, the corresponding working space will act as a pneumatic buffer, in which case the resulting excess pressure can be utilized for generating compressed air to permit energy recuperation.

The control device of the present invention becomes particularly simple if, for admitting pressure to the working space, whose force acts in the working stroke direction (moving direction of the pressure box during the drawing operation), a pressure level is used which has a defined height. Correspondingly large buffer volumes prevent excessive pressure changes during the movement of the pressure box so that the sheet holding force depends essentially only on the connected pressure level.

In another particularly advantageous embodiment of the present invention, the pressure box is provided with several hydraulic cylinders which act upon the studs for transmitting force to the sheet holding ring. The hydraulic cylinders can be controlled individually or in groups. Advantageously, a control device is used for this purpose which contains no proportional valves but switching valves, which when mounted on the pressure box, can better withstand the occurring shock-related stress. The switching valves permit at least two operating modes, whereby, in one of the two operating modes, the hydraulic cylinders of one group are connected with the hydraulic cylinders of at least one other group so that a pressure compensation is possible. As a result, local force fluctuation, for example, because of different stud lengths, can be compensated or excluded. In the other operating mode, the hydraulic cylinders are individually or in groups switched to a different pressure level or, for example, switched to a no-pressure state. In this manner, the sheet holding force can be reduced locally so that, for influencing the flow of material, a force distribution can be adjusted in a targeted manner along the sheet holding ring. A functional separation is therefore established between the generating and the time-dependent controlling of the sheet holding force overall and the adjusting of the local distribution of the sheet holding force. The overall force is applied by the pneumatic driving device, while the force distribution is adjusted by the hydraulic cylinders.

Advantageously, a carrier or force transmitting device (e.g., a slightly elastic plate) is arranged between the hydraulic cylinders and the studs. Thus, the number of the studs can exceed the number of hydraulic cylinders. With a defined number of studs, a comparatively lower number of hydraulic cylinders will be sufficient which reduces the constructional expenditures and the control expenditures.

When individual hydraulic cylinders are combined to groups, the control expenditures are reduced. The groups are preferably arranged such that, with sheet holding rings of different sizes, a force distribution becomes possible whose stages are as small as possible. This is achieved in that the groups are arranged essentially radially starting from a center point of the pressure box.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 1:
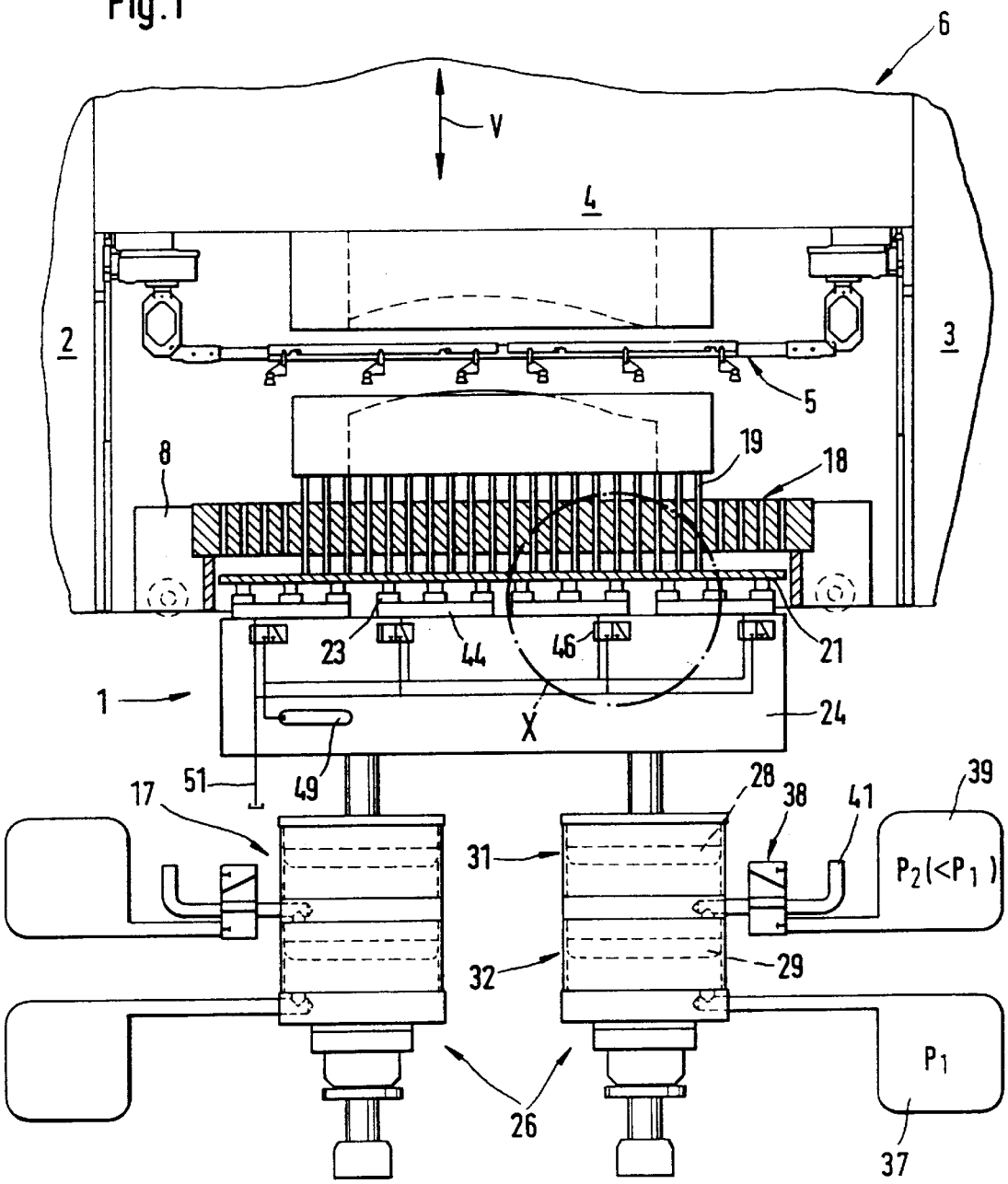
FIG. 1 is a schematic cross-sectional partial view of a press with a drawing apparatus according to the present invention.
Figure 2:
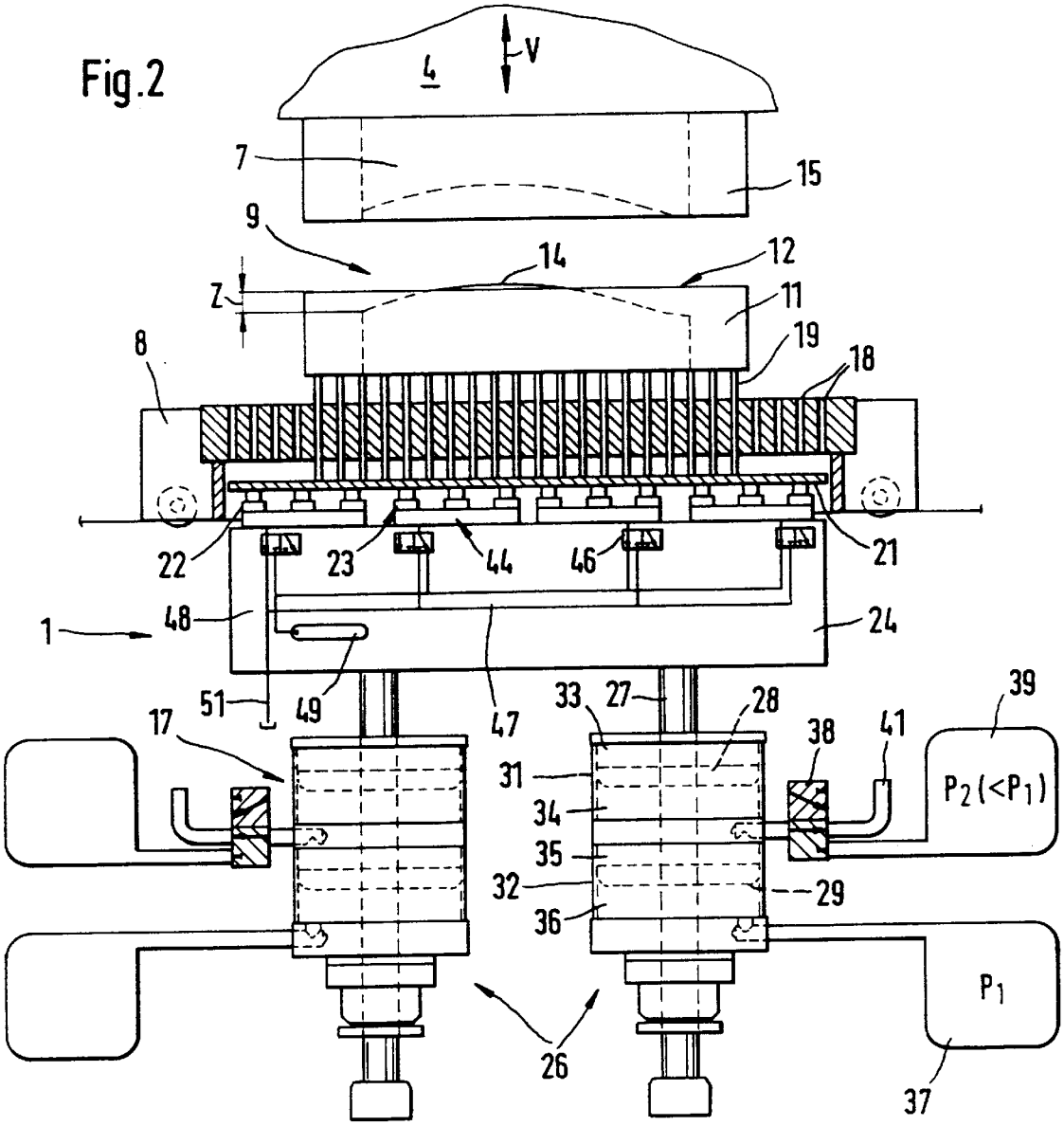
FIG. 2 is a schematic view of a drawing apparatus shown in FIG. 1 but with a symbolically outlined tool.

FIG. 1 illustrates a drawing device 1 of a press 6 which is otherwise shown only by way of its stands 2, 3, its slide 4 and its transfer device 5. The slide 4 is driven vertically in a stroke direction V and, as illustrated schematically in FIG. 2, is provided with a top tool 7. Below the top tool 7, a sliding table 8 is stationarily arranged on which a bottom tool 9 is held. The bottom tool 9 includes a sheet holding ring 11 which has an essentially plane top side 12 or one adapted to a drawing edge contour and can be moved in the vertical direction V. The sheet holding ring 11 surrounds a bottom die 14 which is stationarily disposed on the sliding table 8 and which has a contour which corresponds to the shape of the sheet part to be deep drawn. The countercontour is situated on the top tool 7 on which a pressure surface 15 is constructed (dash lines in FIG. 2) which is arranged opposite the top side 12 of the sheet holding ring 11 and which is plane or is adapted to the contour of the top side 12. The pressure surface 15 and the top side 12 of the blank holding ring 11 are used for holding the sheet edge of a sheet to be deep drawn. For improving the clamping-in of the sheet edge, the top side 12 and the pressure surface 15 may be provided with grooves or projections.

When the slide 4 carries out a slide stroke which clearly exceeds the drawing depth, the sheet holding ring 11 can be vertically moved at least corresponding to She drawing depth Z. In its highest position, it is lifted so far that the top side 12 is at least just as high as the highest point of the contour of the bottom die 14. At its lowest point, it is lowered as far as required by the drawing depth. During the drawing operation, the sheet holding ring 11 is acted upon by a vertically upwardly directed force by a driving or force-admission device 17 and is pressed by the pressure surface 15 against this force synchronously with the slide movement 4 in the downward direction.

For acting upon the sheet holding ring 11 by a force directed against the drawing movement of the slide 4, the sliding table 8 is provided with a plurality of preferably uniformly arranged, vertical passage openings 18, into which vertically displaceable studs 19 can be inserted. These studs 19 are essentially constructed to have the same length and are inserted into the openings 18 which are situated under the sheet holding ring 11 around the bottom die 14. All studs 19 rest by way of their upper front face against the sheet holding ring 11 which is supported on the studs 19.

The lower end of the studs 19 provides support on a so-called floating plate 21 which, in turn, is carried by a plurality of pressure pistons or piston rods 22 of small hydraulic cylinders 23 and is used as a force distributing element. The hydraulic cylinders 23 have only a small stroke which is clearly less the drawing depth Z. The hydraulic cylinders 23 are carried by a pressure box 24 which can be vertically adjusted by way of the drawing depth Z.

For acting upon the pressure box 24 by way of an upwardly directed force and by way of the floating plate 21, the studs 19 and the sheet holding ring 11 finally against the pressure surface, at least one pneumatic cylinder 26 is, preferably having an identical construction where plural cylinders are provided. Each pneumatic cylinder 26 has at least one, preferably two pistons 28, 29 which are fastened on a common piston rod 27 and which each division off working spaces 33, 34, 35, 36 in a cylinder volume 31, 32. The working spaces 34, 35 which, when acted upon by pressure, generate an upwardly directed force acting on the piston rod 27, are connected to an air volume (air vessel) 37 which has an adjustable but essentially unchanged pressure $P_1$.

The number and size of the pistons 28, 29 and the pressure of the air volume 37 are adjusted such that the generated force is sufficient for pressing the pressure box 24 and all parts supported thereby, including the sheet holding ring 11, upwards with such a force that the desired sheet holding force is achieved at the sheet edge clamped in between the top side 12 of the sheet holding ring 11 and the pressure surface 15.

The sheet holding force can be reduced as required based on the maximal force. For this purpose, the upper working spaces 33, 35 are connected by way of a valve device 38 to another air volume (air vessel) 39 with an air pressure $P_2$. The air pressure $P_2$ is lower than the air pressure $P_1$ of the air volume 37. The air vessels (air volumes) 37, 39 are sized dimensioned such that the pressure $P_1$ and $P_2$ changes only insignificantly when the concerned piston 29, 28 travels through its full piston stroke and when the working spaces 33, 35 are connected with the air volume 39 via the valve device 38.

In the simplest case, the valve device 38 is a 3/2-way valve; i.e., a switching valve, by way of which the working space 35 can optionally be connected with the air vessel 39 or with an outlet 41. As required, a directional control valve may also be provided which, in addition to the valve positions illustrated in FIG. 2, has another valve position in which the working space 35 is closed off to the outside.

Figure 6:
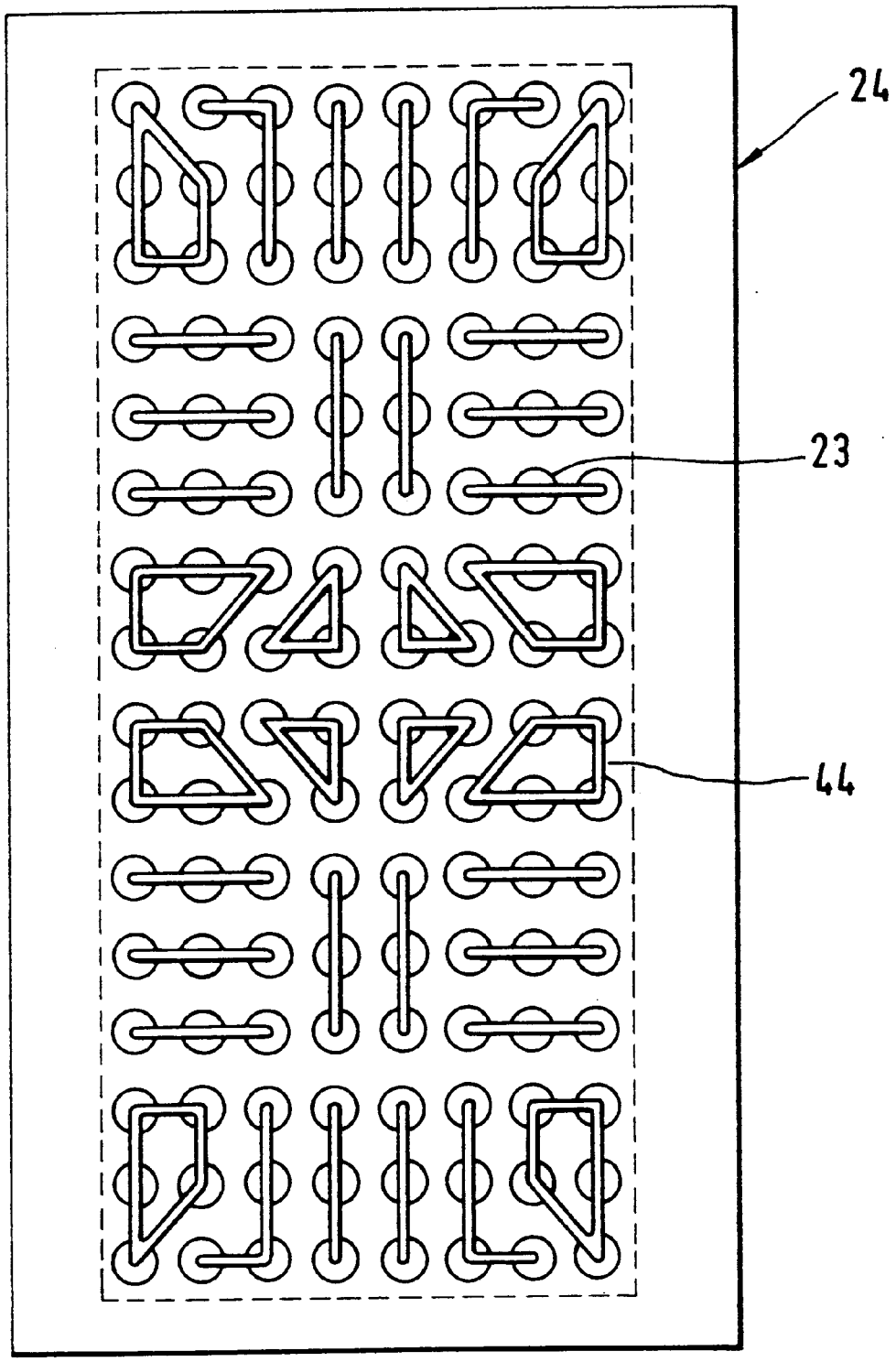
FIG. 6 is a top view of hydraulic cylinders arranged on a pressure box and their combination to individual, jointly controlled groups.

While the required lateral course of the sheet holding force and the dependence of the sheet holding force on the drawing path can be adjusted by the force generating device 17, the hydraulic cylinders 23 are used for the local adjustment of the sheet holding force component independently of the drawing path. For this purpose, the hydraulic cylinders 23 are combined into groups 44 which are arranged as schematically illustrated in FIG. 6 on the pressure box 24. The groups 44 are symbolized in FIG. 6 by thickly drawn-out connection lines between the hydraulic cylinders 23 pertaining to the group. The groups 44 contain three to five hydraulic cylinders 33 and are arranged in the center 45 of the pressure box 24 in groups of threes defining triangles and are arranged in the outer area in the form of oblong groups which extend away from the center 45 of the pressure box 24. The arrangement is such that a rectangular sheet holding ring 11 carried by the studs 19 and the floating plate 21 by the hydraulic cylinders 23 crosses as many groups 44 as possible.

Figure 3:
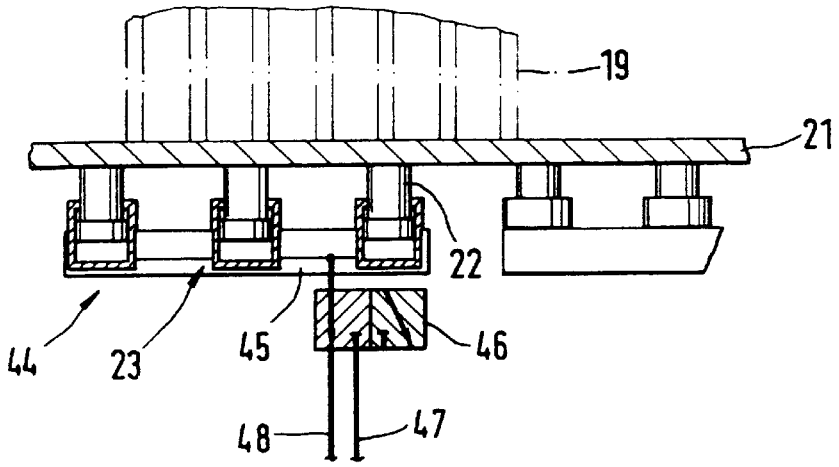
FIG. 3 is a schematic view of hydraulic cylinders which are part of the drawing apparatus of FIG. 1 and which have a floating plate arranged thereabove.
Figure 4:
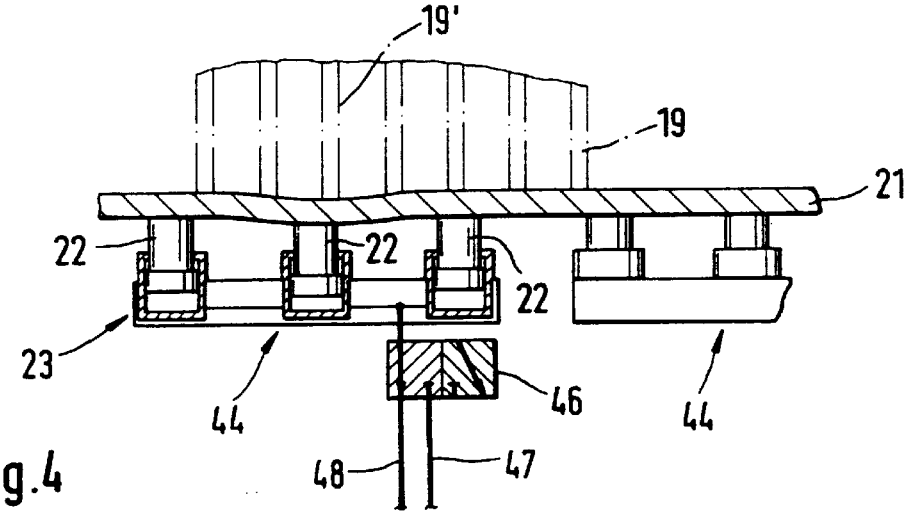
FIG. 4 is a schematic view of the hydraulic cylinders shown in FIG. 3 but when studs of different lengths are used.

For controlling the groups 44, the hydraulic cylinders 23 of each group 44 are first connected with one another as shown, for example, in FIG. 3. For this purpose, a line 45 is used which is connected to a 3/2-way directional valve 46 which is used as a simple switch-over valve for the optional connection of the line 45 and thus of the cylinders 23 with different pressure levels, for example, of a line 47 acted upon by pressure or of a line 48 relieved from pressure. The line 47 connects all directional control valves 46 of all groups 44 with one another as well as with a pressure accumulator 49. The pressure existing in the pressure accumulator 49 shown in FIGS. 1 and 2, or the maximal pressure can be adjusted as required. The line 48, which connects the directional control valves 46 with one another, leads to an outlet 5i. As an alternative, the pressure accumulator 49 may also be eliminated so that the hydraulic cylinders 23 communicate with one another for a corresponding valve position, whereby the pressure is adjusted automatically as a result of the sheet holding force.

Under the prerequisite that a uniform force distribution onto the sheet holding ring 11 is desired, all directional control valve 46 are switched so that they connect the concerned group 44 with the pressure accumulator 49. Before the start of a drawing stroke, the transfer device 5 places a sheet bar on the top side 12 of the sheet holding ring 11 situated in the upper position. The force generating device 17 holds the pressure box 24 in the upper position. This is achieved by connecting the working spaces 34, 36 with the air vessel or air volume 37 and are therefore acted upon by $P_1$ pressure. In contrast, the working spaces 33, 35 are connected with the outlet 41 and therefore have no pressure.

Because of the downward movement of the slide 4, the pressure surface 15 of the top tool 7 is placed on the sheet bar situated on the sheet holding ring 11 and presses this sheet bar together with the sheet holding ring 11 downwards against the force of the force generating device 17. Thereby, the sheet bar edge is clamped in and is held in this manner. The holding force is determined by the force applied by the force generating device 17.

The studs 19 used for the force transmission between the sheet holding ring 11 and the pressure box 24 are supported on the floating plate 21 which distributes the pressure onto the hydraulic cylinders 23. Because of the elasticity of the floating plate 21, the force transmitted by each stud 19 is determined by the force applied by the hydraulic cylinders 23. This force is, however, relatively independent of local deformations of the floating plate 21, as may occur, for example, as the result of studs 19', 19 of different lengths within a tolerance. Although the stud 19' is longer than its adjacent studs 19, there is no force excess at the stud 19' because each of the mutually communicating hydraulic cylinders 23 can only transmit the same force.

If, during the drawing operation, for example, after passing through a portion of the drawing path, the sheet holding force is to be reduced, for example, in order to permit a flow of material to the drawing edge in a targeted manner, the sheet holding force is reduced in a targeted manner. This takes place by acting upon the working space 35 as well as the working space 33 via the pressure $P_2$ by switching over of the valve device 38. This counterpressure reduces the pressure differences between the working spaces 35, 36; 33, 34 and thus the force delivered at the piston rod 27.

When the slide 4 has passed through its lowest point, the driving device 17 presses the sheet holding ring 11 upwards and therefore lifts the formed workpiece off the bottom die 14. If the sheet holding ring 11 is to stop before having reached its highest point, a conventional mechanical stop (not shown) may be provided to allow the pressure box to stay temporarily in an intermediate position. As an alternative, the valve device 38 may be constructed to block the working spaces 33, 35 so that the pressure cushion which is built up here when the pressure box 24 moves up acts as a brake. The compressed air formed in this process can be used for an additional advantageous purpose.

Figure 5:
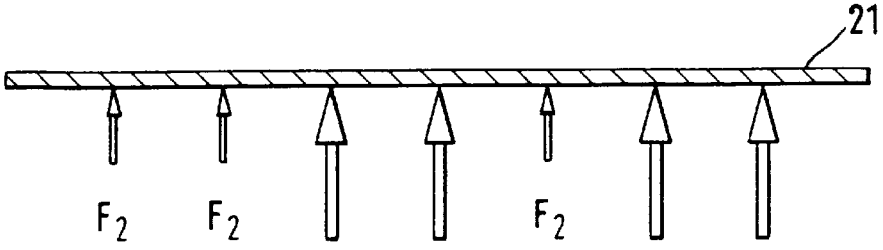
FIG. 5 shows the force distribution on a sheet holding ring with differently controlled hydraulic cylinders.

If a locally different sheet holding force is desired, individual groups 44 can be connected with the pressure accumulator 49 and other groups 44 can be relieved from pressure as symbolically outlined in FIG. 5. Hydraulic cylinders which are connected with the pressure accumulator 49 can take over a relatively large component $F_1$ of the force delivered by the force generating device 17, and the hydraulic cylinders 23 which are relieved from pressure or are acted upon by a lower pressure take over only a lower force component $F_2$. Because of the somewhat elastic floating plate 21, this force distribution affects the studs 19 and the sheet holding ring 11. In this manner, a lower sheet holding force can, for example, be adjusted at defined points of the drawing edge, such as in the corner area, in order to increase the flux of material here.

If the overall force is to be influenced, for example, not only in two stages by an admission of counterpressure to the working spaces 33, 35, the working spaces 33, 35 are acted upon by the $P_2$ pressure level independently of one another. At least three graded sheet holding values are therefore obtained.

In summary, a drawing device 1 provided for drawing presses has a sheet holding ring 11 which travels through the entire drawing path during the drawing operation. For acting upon the sheet holding rings 11 by way of a corresponding sheet holding force, a pneumatic force generating device 17 is provided with pressure cylinders whose working spaces 34, 36 are permanently or statically acted upon by compressed air with a defined pressure level. For adjusting the sheet holding force, the corresponding pistons 28, 29 of the force generating device 17 can be acted upon on their opposite side with counterpressure of a determined pressure level $P_2$. Thus, the course of the sheet holding force can be adjusted by way of the drawing depth.

For the local adjustment of the distribution of the sheet holding force along the sheet holding ring 11, hydraulic cylinders 23 are used which are arranged between the sheet holding ring 11 and the pressure box 24 and are combined into groups 44. Communicating by way of switch-over valves 46, these groups 44 can be switched to a first reservoir, and communicating alternatively, can be switched to a second reservoir. In conjunction with the pneumatic force generating device, the hydraulic cylinders 23 supply a certain buffer effect or damping effect which becomes effective when the pressure surface 15 is placed on a sheet bar situated on the sheet holding ring 11.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Drawing device for a drawing press, including a deep drawing press, comprising a pressure box configured as an abutment for generating a clamping force for holding a sheet edge and disposed to be movable in a drawing direction by a defined drawing depth, a force generating device comprising a controllable pneumatic driving device which, on one end, is operatively connected with the pressure box and, on the other end, is supported on a stationary bearing, for acting upon the pressure box by way of a force parallel to the drawing direction, and force transmitting elements forming a force transmitting device for transmitting the clamping force to a sheet holding device and comprising displaceable studs operatively associated with a floating plate and displaceable cylinders which are controllable individually and in groups and which provide pressure compensation to maintain substantially constant pressure applied by the pneumatic driving device.

2. Drawing device according to claim 1, wherein the pressure box is arranged to be movable along a path which corresponds to the drawing depth and, at each point of the path, is actuatable by a clamping force provided by the pneumatic driving device.

3. Drawing device according to claim 1, wherein the pneumatic driving device is a differential pressure arrangement having at least one first working space actuatable by pressure from which a force originates to point in a working stroke direction, and at least one second working space actuatable by pressure from which a force originates which is directed against the working stroke direction.

4. Drawing device according to claim 3, wherein, for adjusting the force delivered by the driving device, means is provided for influencing admission of pressure to the working space to provide a force pointing in the working stroke direction.

5. Drawing device according to claim 4, wherein, for admitting pressure to the working space whose force acts in the working stroke direction, means is provided for producing a pressure level with a defined pressure.

6. Drawing device according to claim 3, wherein the working spaces are each connected to buffer volumes configured to limit the pressure change in the working spaces during movement of the pressure box by a defined path distance to a value below a defined limit value.

7. Drawing device according to claim 3, wherein a control device is arranged to switch the working space, which is reduced during the return stroke of the pressure box, as a damping volume, the control device utilizing an occurring pressure rise in the damping volume for generating compressed air.

8. Drawing device according to claim 1, wherein the cylinders which are part of the force transmitting elements are provided on the pressure box and are hydraulic cylinders connected with a control device so as to control the hydraulic cylinders individually and in groups, and to provide the pressure compensation.

9. Drawing device according to claim 8, wherein the hydraulic cylinders are controllably combined into the groups which extend away from a center of the pressure box.

10. Drawing device according to claim 8, wherein the control device contains switching valves which optionally switch the hydraulic cylinders or the groups between at least two reservoirs.

11. Drawing device according to claim 8, wherein the control device contains switching valves which optionally connect the hydraulic cylinders or the groups with one another or to be pressureless.

12. Drawing device according to claim 8, wherein the hydraulic cylinders have pistons rods for carrying a carrier device on which studs are supported which comprise the force transmitting device.

13. Drawing device according to claim 12, wherein the carrier device is an elastically resilient plate.

14. Drawing device according to claim 12, wherein the number of studs differs from the number of hydraulic cylinders.

* * * * *